US006174265B1

(12) United States Patent
Alessandri

(10) Patent No.: US 6,174,265 B1
(45) Date of Patent: Jan. 16, 2001

(54) LOAD SELECTOR, IN PARTICULAR FOR EXERCISE MACHINE

(75) Inventor: Nerio Alessandri, Longiano (IT)

(73) Assignee: Technogym S.r.l., Gambettola (IT)

( * ) Notice: Under 35 U.S.C. 154(b), the term of this patent shall be extended for 0 days.

(21) Appl. No.: 09/120,233

(22) Filed: Jul. 22, 1998

(30) Foreign Application Priority Data

Jul. 22, 1997 (IT) ..... BO97A0446

(51) Int. Cl.[7] ..... A63B 21/06

(52) U.S. Cl. ..... 482/5; 482/98; 482/99; 482/100

(58) Field of Search ..... 482/5, 94, 98–103

(56) References Cited

U.S. PATENT DOCUMENTS

| | | | | |
|---|---|---|---|---|
| 90,309 | * | 5/1869 | Reilly | 482/94 |
| 1,053,109 | * | 2/1913 | Reach | 482/99 |
| 3,438,627 | * | 4/1969 | La Lanne | 482/103 |
| 4,546,971 | | 10/1985 | Raasoch . | |
| 4,610,449 | | 9/1986 | Diercks, Jr. . | |
| 4,746,113 | | 5/1988 | Kissel . | |
| 4,834,365 | | 5/1989 | Jones . | |
| 4,971,305 | | 11/1990 | Rennex . | |
| 5,306,221 | * | 4/1994 | Itaru | 482/98 |
| 5,350,344 | | 9/1994 | Kissel . | |
| 5,556,362 | | 9/1996 | Whipps . | |
| 5,643,151 | * | 7/1997 | Naimo | 482/98 |
| 6,015,367 | * | 1/2000 | Scaramucci | 482/5 |

FOREIGN PATENT DOCUMENTS

| | | |
|---|---|---|
| 0177643 | 4/1986 | (EP) . |
| 2126894 | 10/1972 | (FR) . |

* cited by examiner

*Primary Examiner*—J. Mulcahy
(74) *Attorney, Agent, or Firm*—Pillsbury Madison & Sutro LLP

(57) ABSTRACT

A load selector, in particular for an exercise machine in which a load to be used in an exercise is variable and is determined by a value of a sum of a plurality of weight elements which are associated, through related fastening elements, to a tugging element comprising a rod kinematically connected to appropriate connectors able to exert a force by a user; the weight elements can be stacked on top of one another and present corresponding holed portions able to define a channel for the rod, the rod presents, along its own longitudinal development, i.e., along a direction of development of the aforesaid channel, cross sections of alternatively differentiated value to define thereby a series of notches or tapers; the fastening elements comprise a plurality of coupling elements, positioned in correspondence with each of the weight elements, and movable between a first position in which they do not interact with the rod and a second position in which they do interact with the rod itself, in correspondence with one of the notches or tapers, for a determination of the load.

18 Claims, 3 Drawing Sheets

LOAD SELECTOR, IN PARTICULAR FOR EXERCISE MACHINE

BACKGROUND OF THE INVENTION

The present invention relates to a load selector, in particular for an exercise machine that allows a variation of the resistance offered to the user thanks to a corresponding variation of the load related to a certain exercise.

Numerous physical fitness or rehabilitation exercises entail the use of a load to provide a reaction to the force imparted by the user.

Currently, "traditional" weight training, such as dumbbells, bars and the like, have been, to a great extent, replaced by exercise machines that are more complex and correlated to their use, indicated as isotonic machines. Such machines comprise a base frame whereto are associated means for the user to impart a force, such as a bar, handles or oar-shaped levers, connected to a load which provides a resistance to the imparted force. The load, gravitational, is defined by the weight of a series of brick- or disk-shaped weights, able to be placed in different mutual association according to the exercise to be performed until reaching the desired weight value. The connection between the means for imparting the force and the load is constituted by a cable or by a chain wound around transmission pulleys or through a lever system directly associated to the load and to the means for imparting the force.

In practice, according to the most widely used embodiment, an exercise machine comprises a metal structure provided with a seat for the user (when necessary, of course) and a vertical guide destined to allow sliding by a series of weights connected, through the aforesaid chain or cable, to a bar (or other element for the application of force) which is gripped by the user to perform work generated by lifting the weights, thereby sliding them along the guide.

A drawback of the machine currently in use derives from the ways whereby the working load is determined, i.e. by the manner in which the weights are associated to the chain or to the cable. Each weight can slide along the aforesaid vertical guide and it presents at least one vertical through hole and one horizontal through hole mutually intersecting; the superposition of the weights determines, in correspondence with the vertical holes, a sliding channel for a connecting rod positioned vertically and connected, in its upper end, to the chain; the selection of the load for the exercise to be performed is made manually by inserting a locking pin, passing through one of the horizontal holes presented by the weights, into one of the seats provided on the rod at different heights corresponding to the thickness of the weights. In this manner, all the weights located above the inserted pin are associated with the rod, and hence with the chain; by varying the insertion height, the number of weights associated with the chain and, hence, the load for the exercise is varied.

When, on the same machine, a series of exercises requiring different loads is to be performed (for instance, in passing from a series to the next one), or when the same machine is used by multiple persons alternating with different loads, it is necessary, for each change, to set the machine up, removing the locking pin and inserting it at a different height; such operation is found annoying, especially if one considers that gymnasium activities generally have a recreational and entertainment character. Among prior art solutions, U.S. Pat. No. 4,834,365 is related to a combined system of weights, with which it is possible to select, for the same weight stack, weights of different values.

U.S. Pat. No. 4,971,305 relates to a device that allows adjusting the weight stack having variable values, i.e. on values corresponding to sub-multiples of the unit of measure, with increments of small value. With the aforesaid solutions it is not possible to vary automatically (i.e. not manually) the reaction provided by the machine.

U.S. Pat. No. 5,556,362 relates to a pin for weights able to disengage automatically when the weight stack reaches the rest position. The subject pin can be used to deselect one or more weight bars, but it is not usable to set the load of a given exercise or to increase the load itself.

U.S. Pat. No. 4,610,449 relates to an automatic weight selector which automatically changes the selected weight after a set time interval. The patent describes a structure that fastens a plurality of bars to the tugging rod, through two pins, a lower one and an upper one, inserted in respective seats presented by two weight bars; load differentiation is allowed by a cam device commanded by a timer which, after a set period of time, extracts the lower pin to lighten the load, maintaining, connected to the rod, the above-lying bar and those above it. With the selector, thus described, it is therefore possible to change load by decreasing it and only once, in the course of a break.

U.S. Pat. Nos. 4,746,113 and 5,350,344 relate to exercise machines, wherein the load of the weight stack can be varied. Both documents teach the use of a structure able to be combined to a weight stack and supporting a series of pins movable horizontally between an engaged position wherein they are inserted in the related seats of the weight bars and a release position wherein they are retracted from the seats thereby freeing the weight bars. In practice, it is a sort of plate presenting pins facing the weight stack and able to be activated, by means of solenoids or electromagnetic actuators provided and acting upon each of the aforesaid pins. The solutions taught in the two patents provide for a structure which must follow the weight stack in its vertical stroke.

U.S. Pat. No. 4,546,971 describes an exercise machine wherein the load of the weight stack can be varied through a lever positioned in proximity to the seat destined for the user. The weight bars used in this solution are fitted with a pin passing through the horizontal seat which allows access to the tugging rod of the weight stack. Each pin presents spring means which thrust it towards the outside of the weight bar, in a disengagement position from the tugging rod, and it is fitted with an outward projecting head. The aforementioned lever is connected to a command rod able to slide vertically, provided with cams destined to interact with the heads presented by the pins, thereby thrusting the pins towards the tugging rod, in a number corresponding to the desired load value.

SUMMARY OF THE INVENTION

The object of the present invention therefore is to eliminate the aforementioned drawbacks with a load selector which allows varying of the selection of weights which define the load on an exercise machine.

The load selector is usable, in particular, for an exercise machine in which the load to be used in an exercise is variable and is determined by the value of the sum of a plurality of weight elements which are associated, through related fastening means, to a tugging element comprising a rod kinematically connected to appropriate means able to impart a force by a user. The weight elements are able to be stacked one on top of the other and presenting corresponding holed portions able to define a channel for the rod. The load selector is characterized in that the rod presents, along its longitudinal development, i.e. along the direction of development of the channel, cross sections whose value is alternatively differentiated to define a series of notches or tapers, and in that the fastening means comprise a plurality of coupling elements, positioned in correspondence with each of the weight elements, and are movable between a first position wherein they do not interact with said rod and a second position wherein they do interact with the rod, in correspondence with one of the series of notches or tapers, for the determination of said load.

The technical features of the invention, according to the aforesaid objects, can be clearly seen from the content of the claims reported below and its advantages shall become more readily apparent in the detailed description that follows, made with reference to the accompanying drawings, which represent an embodiment provided purely by way of non limiting example.

DESCRIPTION OF THE PREFERRED EMBODIMENTS

In the figures of the enclosed drawings, the number 1 indicates an embodiment of a load selector according to the invention.

Figure 5:
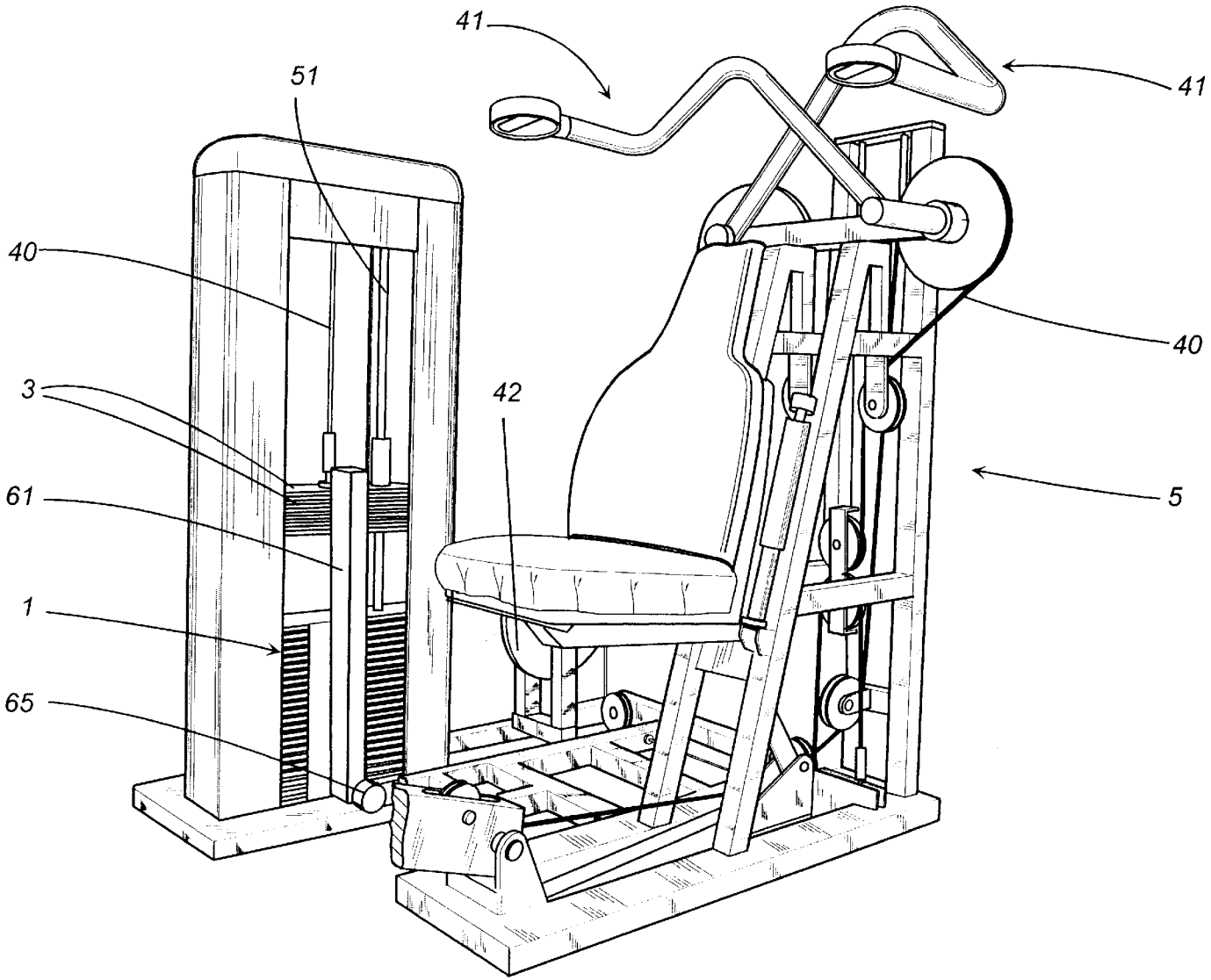
FIG. 5 shows, in an overall perspective view, an exercise machine with variable load equipped with a load selector according to the present invention.

The subject selector 1 finds its application in those exercise machines wherein a gravitational load is provided, determined by the association of a plurality of weight elements to a tugging element connected to means for the execution of a force. In particular, with reference to the drawings which are only a non-limiting example thereof, the means for the execution of the force can comprise a bar, a handlebar, etc.; in the example, such means are indicated by the function block 41 in FIG. 1 and by a part of the exercise machine 5 shown in FIG. 5 and comprising two pivoted arms. In FIG. 5 the parts of the machine not strictly involved in the present invention have not been numbered.

The means for the execution of a force 41 are connected through appropriate means 40, such as a cable or a chain, passing through a transmission pulley 42, to the related load provided on the exercise machine.

Figure 3:
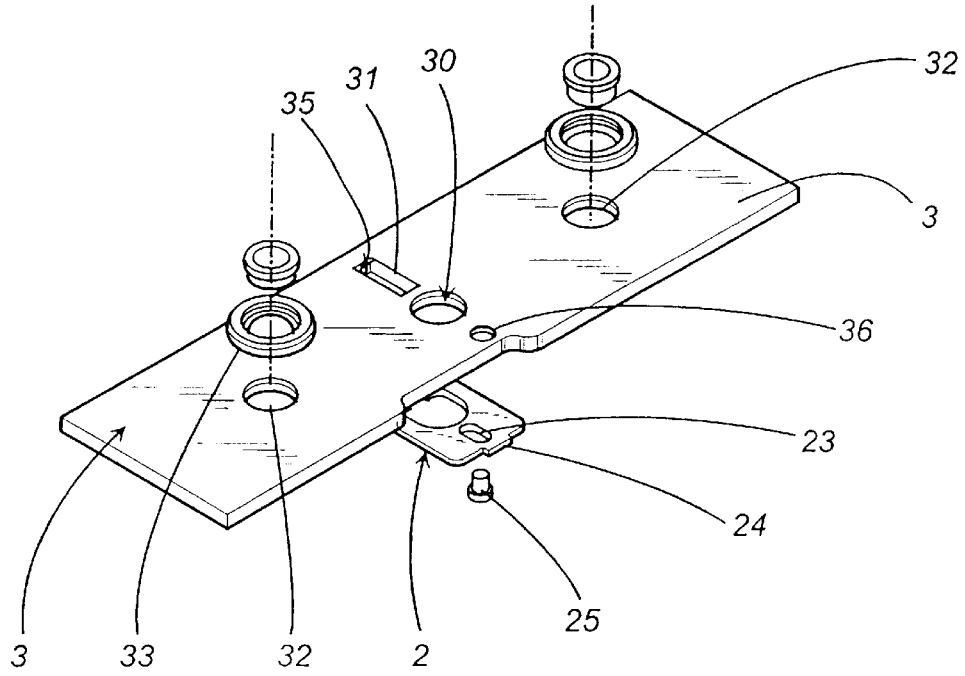
FIG. 3 shows, in a top perspective view, another detail of the embodiment shown in FIG. 1.

The connecting means ends in a tugging element constituted by a connection rod 4 which is connected a plurality of weight elements 3 or bars to determine the load. The weight elements 3 present a pair of holes 32 which allow stacking of the weight elements using rod shaped support organs 51, shown in FIG. 5, developing along the vertical axes indicated by dashed lines in FIG. 3. On each weight element 3 is also provided a hole 30 through which the rod 4 can pass.

In practice, a vertical channel through which the rod 4 can pass is defined. The rod 4 presents, along its own longitudinal development, i.e. along the vertical direction, cross sections whose size is alternatively differentiated in such a way as to define a series of notches or tapers 45.

More in detail, the rod 4 presents a longitudinal profile shaped essentially as a saw tooth, i.e. it presents a configuration defined by a succession of truncated cones with the greater base 44 positioned at the top. This specific conformation is particularly advantageous in that it allows, as shall be explained farther on, the automatic association of the weight elements to the rod 4 itself.

The weight elements 3 are associated with the rod 4 through fastening means which comprise a plurality of coupling elements 2, placed in correspondence with each of the weight elements 3.

The coupling elements 2, which can comprise elements with laminar conformation, are movable between a first position wherein they do not interact with the rod 4 and a second position wherein they do interact with the rod 4 itself, in correspondence with one of the aforesaid notches or tapers 45.

The coupling elements 2 are provided with a slotted portion 20 which is fitted onto the rod 4 and is able to interact therewith in correspondence with the activation of related drive means described here below.

The drive means of the coupling means 2 are constituted by an element 6, movable parallel to the development of the rod 4.

Such movable element 6 is constituted, in the embodiment shown, by a flexible belt contained and able to run within a guide structure 61, 62, 63 shaped as a "U" and extending to encompass the plurality of the weight elements 3.

In practice, around the weight stack is positioned a guide with essentially rectangular open shape which follows its profile vertically on the two sides (61 and 62) and in the bottom portion 63 (shown with dashed line to highlight the belt 6 contained therein).

The coupling element 2 presents an activation end 24 inserted at least partially into a first vertical portion 61 of the guide structure, in such a way as to be pushed by the flexible belt 6 when the latter is at a corresponding height.

Figure 4:
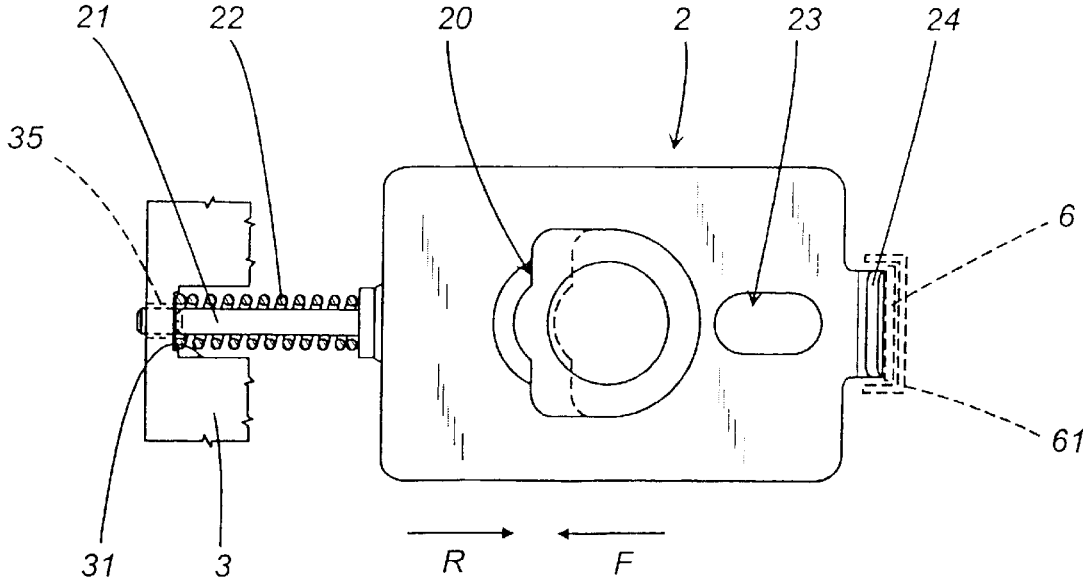
FIG. 4 shows, in a partial top plan view, a detail of the embodiment as per FIG. 1, shown, in part, in two possible operating configurations.

The coupling element 2, as better shown in FIG. 4, presents, on the opposite side with respect to the interaction end 24, a rod-shaped portion 21 whereon a spring 22 is fitted.

Such spring 22 is a possible embodiment of appropriate thrust means 22 presenting a reaction force R directed towards the first belt portion 61. The thrust means 22 maintain the coupling element 2 in contact with the rod 4; in particular, they maintain the slotted portion 20 in contact with one of the notches 45 of the rod 4 itself.

In other words, the coupling element 2 is maintained stably in the engaged position wherein it associates the related weight 3 (and those positioned above it) to the rod 4. When the belt 6 reaches the corresponding height, it thrusts the related coupling element 2 in the direction indicated as F, removing the slotted portion from the rod 4.

In practice the engagement between the weight bar and related rod 4 is determined solely by the action of the spring 22 and therefore all weight bars positioned above the vertical portion of the belt 6 shall be active, i.e. shall concur in the definition of the weight value.

Figure 2:
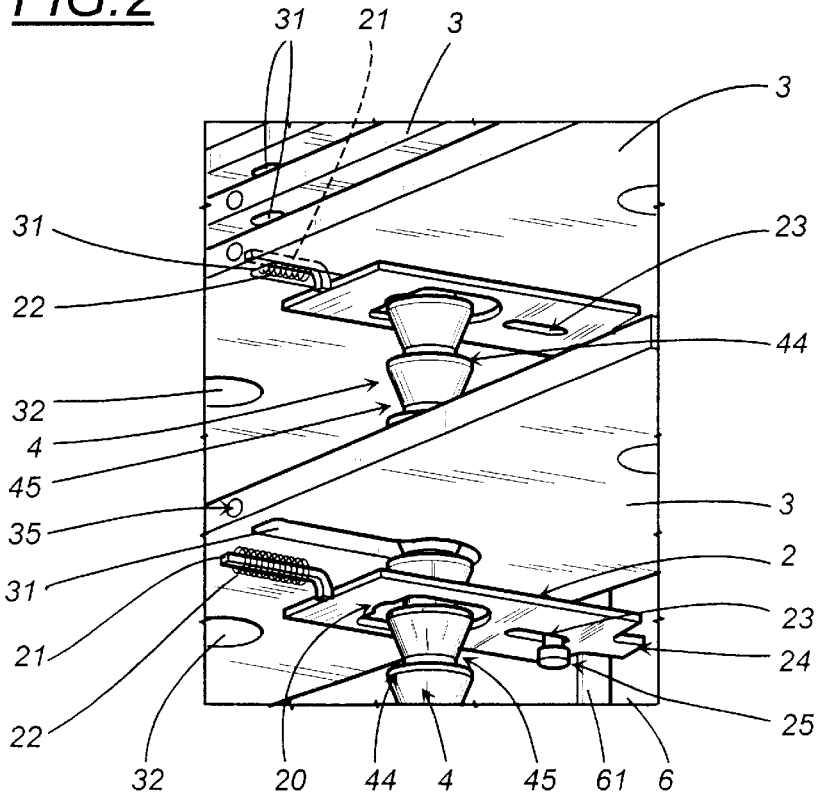
FIG. 2 shows, in a bottom perspective view, a detail of the embodiment as per FIG. 1.

FIG. 2 shows in an upper part a coupling element 2 associated with the related weight bar 3 similar to a possible configuration for use, while, in its lower part, it shows another coupling element 2, disassociated from the related weight bar 3 and, therefore, in a configuration that could not be taken when in use.

For the association of the coupling elements 2 to the weight elements 3, the latter present a slot 31 partially traveled through by the rod-shaped portion 21 of the coupling element 2 and a seat 35 into which is inserted the distal end of the rod-shaped portion 21.

A rivet 25 positioned vertically could also be provided, passing into a related slot 23 provided on the coupling element 2 and fastened in a related hole 36 of the weight element 3.

The fact that the coupling elements 2 are elastically maintained in engaged position in the absence of intervention by the belt 6, and the particular saw-tooth conformation of the rod 4 allow an automatic association of the weight elements to the rod, even when the weight stack selected previously is in a raised position. This characteristic is particularly advantageous in that it allows the automatic mechanism that manages the program of the machine to select beforehand additional weight bars even when the athlete is in an active training phase; the subsequent lowering of the rod 4 towards the motionless weight bars allows a "capture" automatically of the weight bar(s) which in the meantime has or have already been selected by the movement of the belt 6. This allows the athlete to gain time and not to have to interrupt an exercise or multiple series of exercises in order to set the machine differently.

The movement of the flexible belt 6 within the guide structure 61, 62, 63 can be performed by motor means 65 constituted, for instance, by a gear motor, or manual activation means, such as a crank (not shown); in the case of motor drive, the latter can preferably be associated to electronic programming means such as those comprising a support of a "smart key" type.

Figure 1:
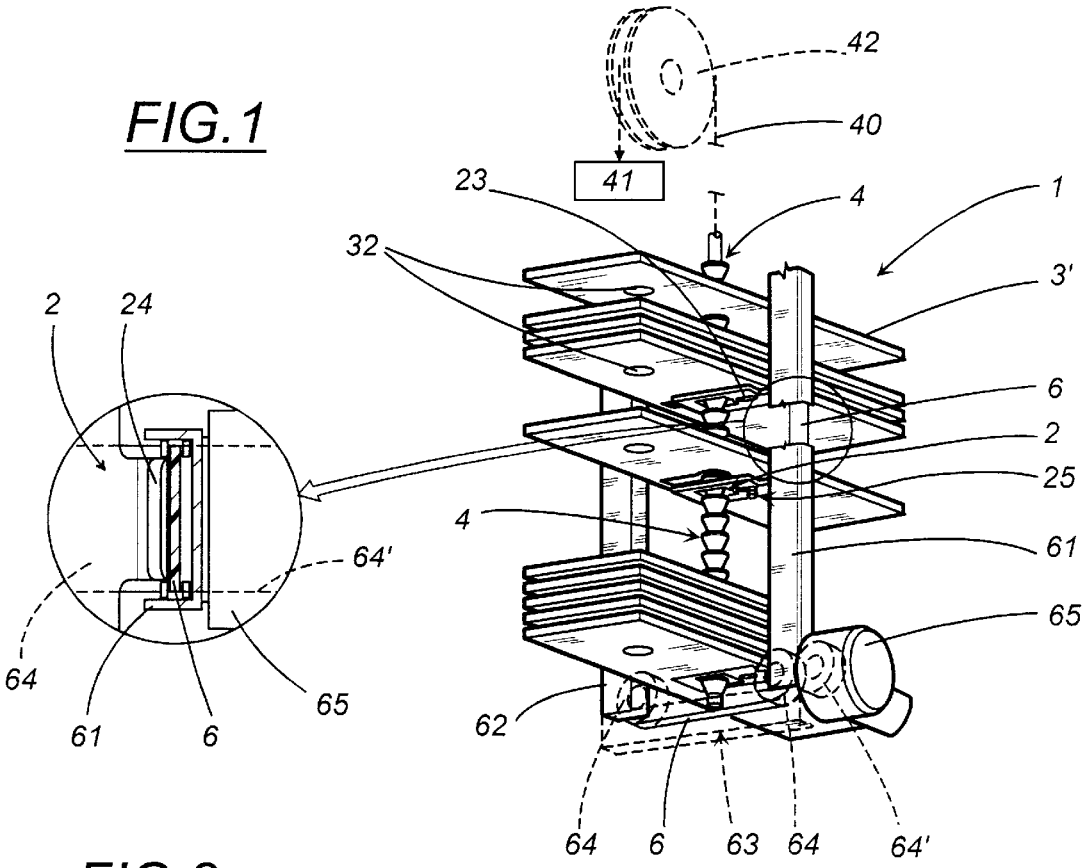
FIG. 1 shows a partial perspective and schematic view of a possible embodiment of the present invention, with a detail in plan view and in enlarged scale.

In the non limiting embodiment shown in FIG. 1, two rollers 64 are provided around which, and externally to which, can pass the belt 6, moved by a driver roller 64', opposed to one of the previous rollers 64, in order thereby to drive the belt 6 by friction. These details have been shown only schematically.

Moreover, the flexible belt 6, in order to interact better with the activation end 24 can present a rounded cross section.

The invention thus conceived can be subject to numerous modifications and variations, without thereby departing from the scope of the inventive concept. Moreover, all details can be replaced by technically equivalent elements.

What is claimed:

1. An exercise machine having a load selector, comprising:

a tugging element including a rod;

a plurality of weight elements stacked on top of one another and associated, through related fastening elements, to said tugging element, a load to be used in an exercise being variable and being determined by a value of a sum of said plurality of weight elements, said weight elements having formed therein corresponding holed portions defining a channel for said rod;

a movable element arranged to be moved in a direction parallel to a development of said rod; and means for transmitting a force exerted by a user, said rod being kinematically connected to said means for transmitting said force by said user; wherein:

said rod has, along a longitudinal direction, a plurality of cross sections of alternatively differentiated value as to define a series of notches or tapers, said fastening elements comprise a plurality of coupling elements positioned in correspondence with each of said weight elements, and being movable between a first position, in which said coupling elements do not interact with said rod, and a second position, in which said coupling elements do interact with said rod, in correspondence with one of said series of notches or tapers, for a determination of said load, said coupling elements being arranged to be moved by said movable element, and said coupling elements are provided thereon with a thrust element able to maintain said coupling elements in said second position.

2. The exercise machine according to claim 11, wherein said rod presents a longitudinal profile shaped essentially as a saw tooth.

3. The exercise machine according to claim 11, wherein said rod presents a conformation defined by a succession of truncated cones with a greater base positioned at a top portion of each of said truncated cones.

4. The exercise machine according to claim 11, wherein said coupling elements comprise elements with a laminar conformation, provided with a slotted portion fitted onto said rod, and able to interact therewith in correspondence with an activation of a related drive.

5. The exercise machine according to claim 1, wherein said coupling elements comprise elements of essentially laminar development, coupled to each of said weight elements, and present a deactivation end able to be thrust by said movable element.

6. The exercise machine according to claim 5, wherein said movable element comprises a flexible belt contained and able to run within a guide structure shaped as a "U" and arranged to extend to encompass said plurality of weight elements, and wherein said deactivation end is constructed and arranged to be at least partially inserted in a first position of said guide structure in such a way as to be thrust by said flexible belt when said flexible belt is at a corresponding height.

7. The exercise machine according to claim 6, wherein on each of said laminar elements are provided with said thrust element with a reaction directed towards a first belt portion able to maintain a slotted portion of said laminar elements in contact with said rod, thereby maintaining said laminar elements in said second position.

8. The exercise machine according to claim 6, wherein on said guide structure are provided a drive able to move said flexible belt to run parallel to said weight elements.

9. The exercise machine according to claim 8, wherein said drive comprises a drive roller positioned along a path of said flexible belt, opposite with respect to an idle roller.

10. A load selector for an exercise machine, comprising:

a guide structure, said guide structure constructed and arranged to surround a plurality of weights stacked one over another;

a movable element constructed and arranged to be moved within said guide structure; and a plurality of coupling elements, wherein:

each of the weights forms a holed portion defining a channel for receiving a rod having a series of notches or tapers, each of said coupling elements being constructed to be positioned in correspondence with the weight elements and the rod passing through the channel defined by the holed portion of the weight elements, said coupling elements being constructed so as to be arranged in a first position, in which said coupling elements do not interact with the rod and a second position, in which said coupling elements do interact with the rod, in correspondence with one of the series of the notches or the tapers, for a determination of a load, said coupling elements being arranged to be moved by said movable element, and each of said coupling elements is provided thereon with a thrust element for maintaining said coupling element in said second position.

11. The load selector according to claim 10, wherein:

a first portion of said coupling elements is constructed to be at least partially inserted into a first portion of said guide structure, said movable element is constructed to be moved within said guide structure such that when said movable element is arranged to be positioned at a same height of at least one of said coupling elements, said first portion of said at least one of said coupling elements comes into contact with said movable element causing said at least one of said coupling elements to be moved to the second position.

12. The load selector according to claim 11, further comprising a drive constructed and arranged to move said movable element within said guide structure.

13. The load selector according to claim 12, wherein said drive further comprises a motor.

14. The load selector according to claim 11, wherein:

said movable element comprises a flexible belt, and said guide structure has a "U" shape.

15. The load selector according to claim 11, wherein said thrust element is constructed to be provided at a second portion of each of said coupling elements to cause a force to be exerted on said coupling element in a direction toward a portion of said guide structure arranged to include said movable element.

16. The load selector according to claim 10, wherein said coupling elements have a laminar conformation and are provided with a slotted portion constructed to be fitted onto the rod.

17. The load selector of claim 10, wherein when said movable element moves said coupling elements, said moved coupling elements are moved to said first position.

18. An exercise machine having a load selector, comprising:

a tugging element including a rod;

a plurality of weight elements stacked on top of one another and associated, through related fastening elements, to said tugging element, a load to be used in an exercise being variable and being determined by a value of a sum of said plurality of weight elements, said weight elements having formed therein corresponding holed portions defining a channel for said rod;

means for transmitting a force exerted by a user, said rod being kinematically connected to said means for transmitting said force by said user; and a movable element for moving a plurality of coupling elements, said movable element being arranged to be moved in a direction parallel to a development of said rod, wherein:

said rod has, along a longitudinal direction, a plurality of cross sections of alternatively differentiated value as to define a series of notches or tapers, said fastening elements comprise the plurality of coupling elements positioned in correspondence with each of said weight elements, and being movable between a first position, in which said coupling elements do not interact with said rod, and a second position, in which said coupling elements do interact with said rod, in correspondence with one of said series of notches or tapers, for a determination of said load, said coupling elements are provided thereon with a thrust element able to maintain said coupling elements in said second position, and said coupling elements comprise elements of essentially laminar development, coupled to each of said weight elements, and present a deactivation end able to be thrust by said movable element.

* * * * *